United States Patent [19]

Applegate et al.

[11] 4,329,075

[45] May 11, 1982

[54] PRINTHEAD ASSEMBLY FOR TYPEWRITERS OR THE LIKE

[75] Inventors: Steven L. Applegate; James J. Molloy, both of Lexington, Ky.

[73] Assignee: International Business Machines Corporation, Armonk, N.Y.

[21] Appl. No.: 163,674

[22] Filed: Jun. 27, 1980

[51] Int. Cl.[3] ..... B41J 33/04

[52] U.S. Cl. ..... 400/229; 400/120; 400/234; 400/235.1; 400/248

[58] Field of Search ..... 400/229, 235.1, 234, 400/208, 248, 118, 119, 120, 121, 123, 124, 224.1, 224; 346/76 R; 219/216

[56] References Cited

U.S. PATENT DOCUMENTS

| | | | |
|---|---|---|---|
| 3,632,969 | 1/1972 | Walkow | 219/216 |
| 3,795,298 | 3/1974 | Kodis | 400/124 |
| 3,822,005 | 7/1974 | Murat | 400/124 |
| 3,855,448 | 12/1974 | Hanagata et al. | 219/216 |
| 3,939,957 | 2/1976 | Bittner | 400/229 X |
| 3,989,131 | 11/1976 | Knirsch et al. | 400/120 |
| 4,134,696 | 1/1979 | Hanakata et al. | 400/121 X |
| 4,145,698 | 3/1979 | Wysong | 346/139 R |
| 4,151,397 | 4/1979 | Boor, Jr. et al. | 219/215 |

FOREIGN PATENT DOCUMENTS

| | | | |
|---|---|---|---|
| 2731607 | 1/1979 | Fed. Rep. of Germany | 400/124 |
| 5555880 | 4/1980 | Japan | 400/120 |

*Primary Examiner*—Clifford D. Crowder
*Assistant Examiner*—C. Pearson
*Attorney, Agent, or Firm*—George E. Grosser

[57] ABSTRACT

A printhead assembly for a typewriter of the kind that swipes a printhead along a ribbon in producing marks on a receiving medium, is mounted to pivot and includes a ribbon guide that serves to wrap the ribbon around the trailing side (for a forward printing direction) of the printhead. The assembly is positioned to permit the printhead to be rotated to a normal printing position at a printing line. By so arranging the ribbon path that the ribbon directions for arrival and departure of the assembly intersect the pivot axis, essentially zero resultant torque may be applied to the assembly by ribbon tension forces and the printing pressure at the receiving medium is, accordingly, unaffected by ribbon tension variations.

13 Claims, 6 Drawing Figures

PRINTHEAD ASSEMBLY FOR TYPEWRITERS OR THE LIKE

BACKGROUND REGARDING THE INVENTION

1. Technology Area

The invention relates to printhead mounting arrangements for a serial printer and more specifically to printhead mounting arrangements for serial printers that employ a printing ribbon that wraps around the printhead.

2. Art Statement

In order to provide print line visibility with a printing system that uses a ribbon, the ribbon is typically wrapped around the printhead so as to avoid obscuring the printed characters on the trailing side (trailing respective of the forward direction for printing) of the printhead. One characteristic of this arrangement is that the ribbon tension forces tug on the printhead and tend to pull it away from the medium receiving the printing marks. This pulling force tends to vary and creates a problem when using a delicate printhead, such as a printhead composed of fine electrodes, because of the increased printhead force required to assure continuous intimate printhead-to-ribbon and ribbon-to-receiving medium contact. Since ribbon supply arrangements generally involve several ribbon path direction changes and some contact with ribbon guides, significant ribbon tension variations are difficult to avoid.

As alluded to above, one way to eliminate the effects of such ribbon tension variations on printing pressure is to maintain the ribbon path parallel to the print line. If the ribbon does not wrap around the printhead, little if any ribbon force is applied to the head. But with such an arrangement, the ribbon blocks the operator's view of the printed characters as a line is printed.

A pattern formed on the operator's side of the ribbon (see U.S. Pat. No. 4,195,937) can serve as a substitute for a view of the line as it is printed. But this is not a feasible alternative for printing systems that do not cause the side of the ribbon away from the receiving medium to become marked.

BRIEF SUMMARY OF THE INVENTION

A printhead assembly for a typewriter that swipes a matrix printhead across a ribbon to produce marks along a printing line is specially pivoted and includes a ribbon guide that causes the ribbon to wrap around the printhead. The pivot axis of the assembly is arranged to be on the leading side of the printhead (for a forward direction of printing) when the printing end of the printhead is rotated to be at the printing line, and the ribbon guide then serves to direct the ribbon away from the printing line on the trailing side of the printhead. With this wraparound ribbon arrangement, the ribbon tension is nonetheless prevented from tugging the printhead away from the printing line by aligning the directions of ribbon arrival and departure of the pivoted assembly to intersect the pivot axis.

By so aligning the ribbon arrival and departure directions, the ribbon tension forces acting on the assembly produce no torque about the pivot axis and, consequently, do not influence the level of torque rotating the printhead toward the printing line. Since the ribbon tension forces do not tend to tug the printhead away from the print line, printing force may be maintained at a generally low level with attendant benefit, particularly, for delicate printheads such as those using numerous fine electrodes that press against the ribbon.

BRIEF DESCRIPTION OF THE DRAWINGS

A presently preferred implementation of the invention will now be described in detail with reference to the drawings wherein.

DETAILED DESCRIPTION OF A PRESENTLY PREFERRED IMPLEMENTATION

Figure 1:
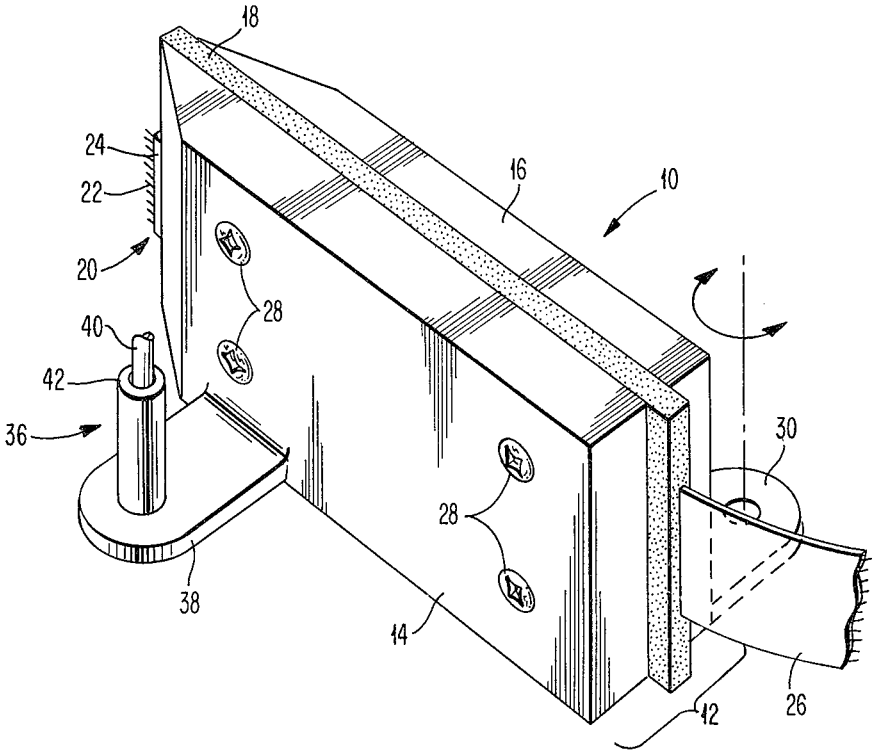
FIG. 1 is a perspective view of a presently preferred printhead mounting assembly according to the invention.

Referring to FIG. 1, a printhead assembly 10 includes a holder section 12 that, for a presently preferred implementation, comprises a first and a second clamping block (denoted 14 and 16, respectively) that are arranged side by side with a compressable pad 18 interposed. Arranged between the compressable pad 18 and clamping block 16 is a printhead 20 which preferably comprises electrodes 22 supported on a flexible substrate 24 which may, for example, be a polyimide material. The electrodes 22 project beyond the holder section 12 at one end (the printing end) to be exposed in a predefined array configuration (a basic linear configuration is assumed for illustration). The clamping blocks 14 and 16 are preferably beveled at the printing end to increase the accessability of the electrodes 22. A flexible conductor strip 26 is electrically connected to the electrodes 22 and permits connection to printhead driver circuitry (not shown). Retaining means 28, such as bolts, screws or rivets, are used for drawing the clamping blocks 14 and 16 together.

The clamping block 16 is intended to be on the leading side of the printhead for a forward printing direction. According to the invention, means such as a pivot tab 30 is connected to the holder section 12 for use in defining a pivot axis on the leading side of the printing head. As is discussed more fully below, the pivot axis is oriented to be generally perpendicular to the direction of relative printing movement by the printhead.

On the trailing side of the printhead, a wraparound ribbon guide 36 is mounted to the holder section 12, for example, by attachment to a guide tab 38. The wraparound ribbon guide is located to cause a ribbon (discussed below) to wrap around the trailing side of the printhead 20. Preferably, the wraparound ribbon guide comprises a pin 40 surrounded by a loose fitting sleeve 42.

Figure 2:
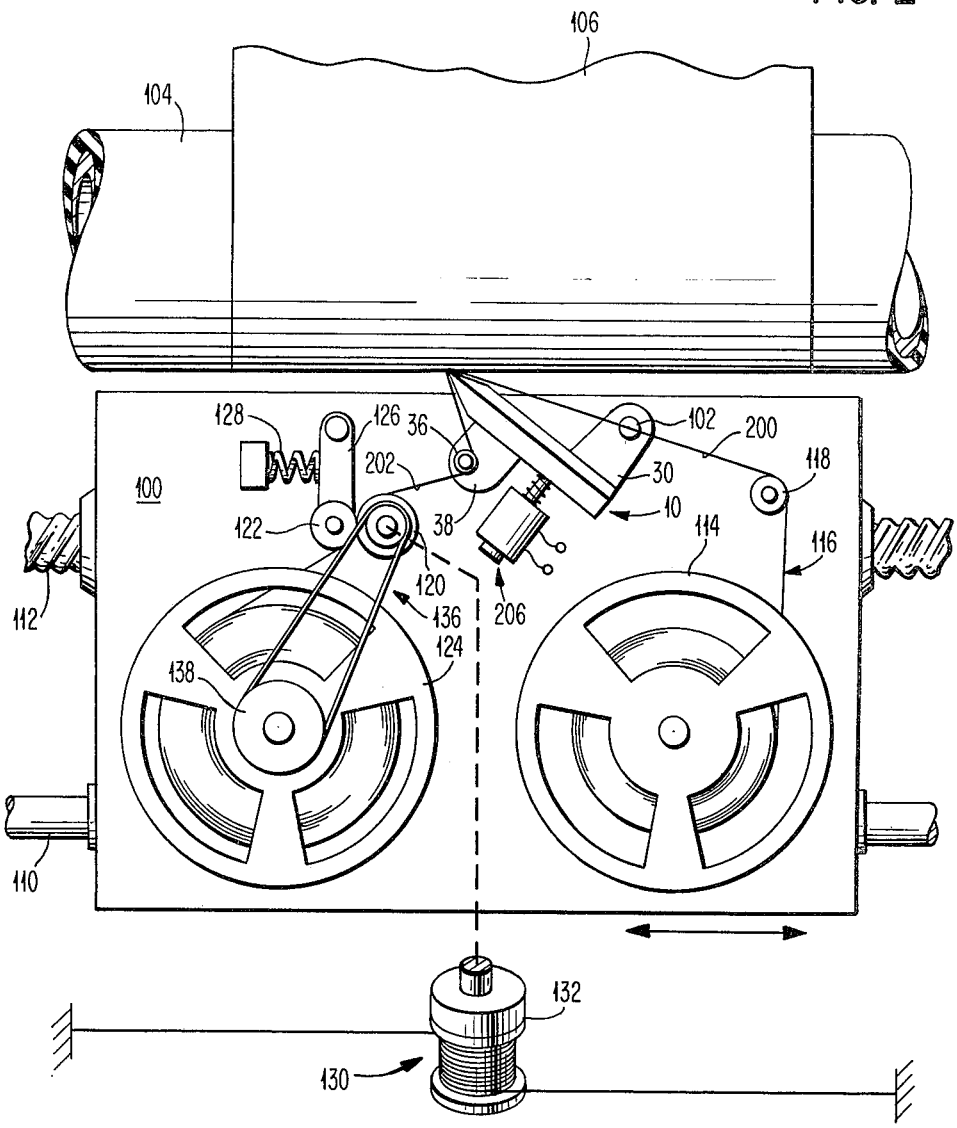
FIG. 2 is a partial plan view of a typewriter incorporating a ribbon feed and printhead arrangement according to the invention.
Figure 3:
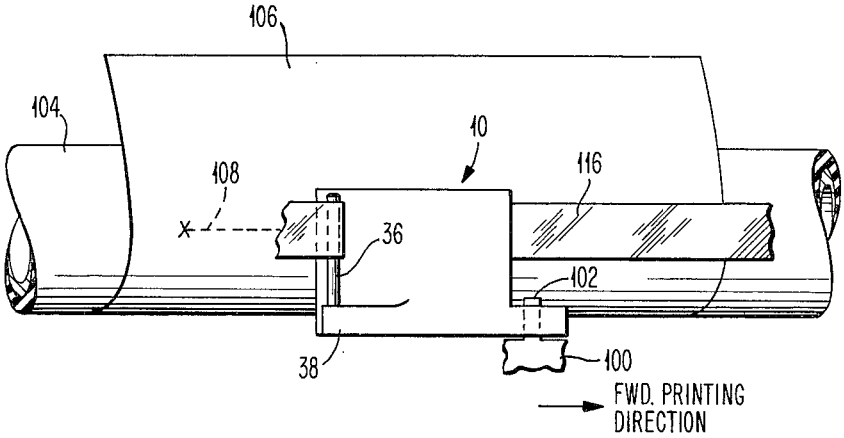
FIG. 3 is a front elevational view of a printhead assembly according to the invention.

Now referring to FIG. 2, the printhead assembly 10 is mounted to the carrier 100 by a pivot pin 102 that extends into a bore defined in the pivot tab 30 (see also FIG. 3). Adjacent the carrier is a document holder such as a platen 104 for supporting a mark receiving medium 106, which may, for example, be a sheet of paper.

Movement of the carrier 100 to establish a printing line 108 (see FIG. 3) occurs along a carrier path defined by a guide rail 110 and such motion is controlled by a leadscrew 112 and cooperating drive system (not shown) as is well known in the art. Other types of carrier positioning control may, of course, be employed and the platen 104 may, as an alternative, be moved to provide relative motion between the electrodes 22 and the receiving medium 106.

The distance from the pivot pin 102 to the print line 108 is selected to be less than the distance from pivot pin 102 to the electrodes 22. Such selection of distances allows the rotational path defined for the electrodes 22 to intersect the print line 108. The rotational position that locates the electrodes 22 at the print line 108 is the normal printing position for the assembly 10 and the printhead is preferably arranged to be on the trailing side (for a forward printing direction) of the pivot pin 102 when the normal printing position is assumed.

Considering now the ribbon system, a ribbon supply such as supply reel 114 feeds a ribbon 116 along a path defined in part by a roller 118, the electrodes 22, and the wraparound ribbon guide 36. Upon exiting wraparound ribbon guide 36, the ribbon 116 is directed to a drive roller 120 that cooperates with a pinch roller 122 to power ribbon advance to a takeup device, such as a reel 124. Preferably, the path of ribbon 116 lies generally in a plane and the pivot axis for assembly 10 is oriented to be perpendicular to the ribbon plane. And it is presently preferred to have the ribbon plane aligned with the printing line 108 so that the pivot axis is generally perpendicular to the direction of relative printing motion for assembly 10.

A pivoted arm 126 supports the pinch roller 122 which is urged against driver roller 120 by a compressed spring 128. Drive motion for advancing the ribbon 116 is coupled to the drive roller 120 by a cable-pulley system 130 which converts carrier motion to rotational motion. Rotational motion is selectively transmitted by a clutch 132 which may, for example, be a unidirectional clutch that transmits only motion corresponding to forward printing movement of the carrier 100 (see also FIG. 3). Motion of drive roller 120 is coupled to takeup reel 124, for example, by a pulley-belt system 136. At the reel 124, a pulley 138 of the pulley-belt system 136 has a slip force level that maintains a desired range of tension for the ribbon 116. As one alternative to using belt slippage for tension control, a spring clutch (not shown) may be inserted between the pulley 138 and the reel 124. To reduce the influence of ribbon tension on the printing pressure at the receiving medium 106, in accordance with the subject invention, the path segments 200 and 202 of the ribbon 116 that extend externally of the printhead assembly 10 are aligned with axes that intersect the pivot axis defined by the pin 102. The term external is here used to indicate some contact with instrumentalities that are not mounted to pivot with the assembly 10 and for the presently preferred implementation, the rollers 118 and 120 are the direction controlling means that are located for establishing these alignments.

Figure 4:
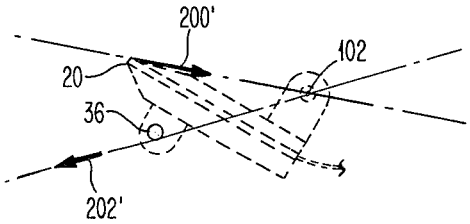
FIG. 4 is a vector diagram indicating ribbon tensions acting on the presently preferred printhead assembly.
Figure 5:
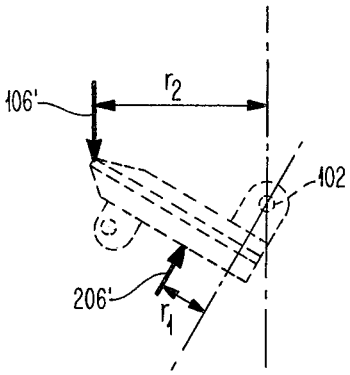
FIG. 5 is a vector diagram indication torque producing forces acting on the presently preferred printhead assembly.

Referring to FIG. 4, the tension forces (denoted 200' and 202') applied by the ribbon 116 at the printhead 20 and the wraparound ribbon guide 36 have no lever arm about the pivot pin 102 and, consequently, produce no torque about the pivot axis. On the other hand, the printhead assembly 10 is rotated toward the receiving medium 106 by the force 206' applied by driver 206 (see FIGS. 2 and 5) with a moment arm $r_1$. A balancing torque 106' is produced by the reaction force at receiving medium 106 which has a moment arm $r_2$. By so arranging the directions of ribbons extending from the pivoted printhead assembly 10, the printing pressure is effectively isolated from the effects of ribbon tension. With the effects of ribbon tension on printing pressure reduced by the pivoted configuration according to the invention, it has been found that the nominal printing pressure may typically be retained at levels comparable to those for configurations with no ribbon wraparound for visibility and at about half the level for typical configurations with wraparound.

Figure 6:
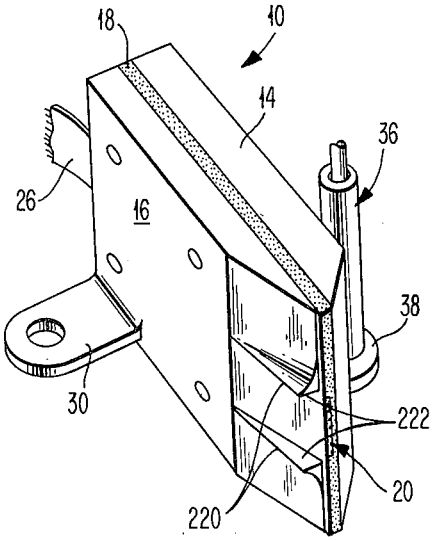
FIG. 6 is a perspective view of the presently preferred printhead that emphasizes edges that are formed near the printing electrodes to guide the printing ribbon.

Referring to FIG. 6, a printhead assembly 10 has a pair of projections 220 that are arranged on clamping block 16 and define guide edges 222 that center the ribbon 116 relative to the printhead 20. With the addition of the projections 220, the printhead assembly 10 serves additionally to align the ribbon 116 in the direction perpendicular to the line of print (see also FIG. 3).

The invention has been described with reference to a presently preferred implementation thereof. However, it will be appreciated that variations and modifications are possible within the intended scope of the claimed invention. For example, various types of printheads may be used including resistor printheads that produce heat at a projecting extremity. Also, various ribbon supply and takeup containers may be used, such as "stuffer boxes".

What is claimed is:

1. For use in a printer of the kind that includes ribbon supply means and ribbon takeup means between which a ribbon is transferred over a ribbon path, document holder means for supporting a receiving medium, a printhead having a printing end that is adapted to swipe along said printing ribbon for producing marks on said receiving medium, and means for causing relative motion between said printhead and document holder means to define a printing line at said document holder means, an arrangement comprising:

an assembly that includes a printhead holder to which said printhead is firmly mounted, pivot means, connected to said printhead holder, for mounting said assembly for rotation to positions about a pivot axis that include a normal printing position in which said printing end of said printhead is located at said printing line, means for defining a section of said ribbon path extending over said assembly, said defining means including first ribbon guide means, mounted to pivot as a part of said assembly, for causing said ribbon to wrap around said printing end of said printhead;

and means for maintaining essentially zero torque about said pivot axis due to tension in said ribbon, said maintaining means including second and third ribbon guide means separate of said assembly for aligning the sections of said ribbon path that extend externally of said assembly and toward said takeup and supply means, respectively, said first and second guide means being positioned so that the line along which the ribbon travels between said first and second guide means passes through said pivot axis, said third guide means being positioned so that the path of said ribbon between said third guide means and said printhead passes through said pivot axis.

2. An arrangement according to claim 1 wherein said ribbon path lies generally in a plane that intersects said print line and said pivot axis is generally perpendicular to said plane.

3. An arrangement according to claim 1 wherein said relative motion causing means includes a carrier moveable along a path parallel to said print line and said pivot means mounts said assembly to said carrier.

4. An arrangement according to claim 3 wherein said supply and takeup means are ribbon reels mounted on said carrier and said second guide means are rollers mounted to said carrier and located on said ribbon path intermediate said reels and said assembly.

5. An arrangement according to claim 1 wherein said printhead holder further includes projecting guides that limit lateral movement of said ribbon.

6. An arrangement according to claim 4 wherein a forward printing direction is defined for motion of said carrier and said pivot axis is to the leading side of said printing end of said printhead respective of said forward direction.

7. A printhead mounting arrangement for use in a typewriter that includes a platen which serves in holding a receiving medium for printing marks and a carrier, located adjacent to said platen, that is supported for movement parallel to said platen along a carrier path, said printhead mounting arrangement comprising:

a printhead having a printing end, a holder that firmly retains said printhead, mounting means for pivotally mounting said holder to said carrier for rotation to positions about a pivot axis including a printing position wherein said printing end of said printhead is at said platen, a ribbon, means, mounted to said carrier, for supplying said ribbon, means, mounted to said carrier, for receiving used ribbon, and means for defining a ribbon path for said ribbon that extends around the printing end of said printhead, said means including first guide means, mounted to pivot with said holder, for causing said ribbon to wrap around the printing end of said printhead, said first guide means being located on said ribbon path between said printing end of said printhead and said receiving means, second guide means, mounted to said carrier and located on said ribbon path intermediate said first guide means and said receiving means for guiding said ribbon, said second guide means being positioned to align a section of said ribbon extending between said first and said second guide means with an axis intersecting said pivot axis at least when said holder is in the printing position, and third guide means, mounted to said carrier and located on said ribbon intermediate said supply means and said printhead for guiding said ribbon, said third guide means being positioned to align a section of said ribbon extending between said third guide means and said printhead to align with an axis intersecting said pivot axis at least when said holder is in the printing position, whereby tension variations in said ribbon are essentially unable to cause torque tending to drive said holder from said printing position.

8. An arrangement according to claim 7 wherein said first, second and third guide means are rollers that define a ribbon path lying generally in a plane that intersects said platen and said holder includes a pair of guide projections that limit lateral ribbon movement from said plane.

9. An arrangement according to claim 7 which further includes means for applying a controlled torque to said holder to press said printhead toward said platen.

10. An arrangement according to claim 8 wherein said supply and receiving means are reels that lie in the ribbon path plane defined by said rollers.

11. A printhead mounting arrangement for use in a typewriter that includes a platen which serves in holding a receiving medium for printing marks and a carrier, located adjacent to said platen, that is supported for movement parallel to said platen along a carrier path, said printhead mounting arrangement comprising:

a printhead having a printing end, a holder that firmly retains said printhead, mounting means for pivotally mounting said holder to said carrier for rotation to positions about a pivot axis including a printing position wherein said printing end of said printhead is at said platen, a ribbon, a supply reel for said ribbon, a receiving reel for said ribbon, and means for defining a ribbon path for said ribbon that extends around the printing end of said printhead, said means including first guide means, mounted to pivot with said holder, for causing said ribbon to wrap around the printing end of said printhead, said first guide means being located on said ribbon path between said printing end of said printhead and said receiving reel, second guide means, mounted to said carrier and located on said ribbon path intermediate said first guide means and said receiving reel for guiding said ribbon, said second guide means being positioned to align a section of said ribbon extending between said first and said second guide means with an axis intersecting said pivot axis at least when said holder is in the printing position, and third guide means, mounted to said carrier and located on said ribbon intermediate said supply reel and said printhead for guiding said ribbon, said third guide means being positioned to align a section of said ribbon extending between said third guide means and said printhead to align with an axis intersecting said pivot axis at least when said holder is in the printing position, whereby tension variations in said ribbon are essentially unable to cause torque tending to drive said holder from said printing position.

12. An arrangement according to claim 11 wherein said first, second and third guide means are rollers that define a ribbon path lying generally in a plane that intersects said platen and said holder includes a pair of guide projections that limit lateral ribbon movement from said plane.

13. An arrangement according to claim 11 which further includes means for applying a controlled torque to said holder to press said printhead toward said platen.

* * * * *